US006014120A

United States Patent [19]

Chiu et al.

[11] Patent Number: 6,014,120

[45] Date of Patent: Jan. 11, 2000

[54] LED DISPLAY CONTROLLER AND METHOD OF OPERATION

[75] Inventors: Scott Chiu, Tempe; Marlene J. Begay, Chandler; Scott R. Novis, Tempe, all of Ariz.; John B. Van Zile, Lake Worth, Fla.

[73] Assignee: Motorola, Inc., Schaumburg, Ill.

[21] Appl. No.: 08/668,960

[22] Filed: Jun. 24, 1996

[51] Int. Cl.[7] ..... G09G 3/32

[52] U.S. Cl. ..... 345/82; 345/55

[58] Field of Search ..... 345/82, 63, 59, 345/89, 509, 515, 516, 196, 55

[56] References Cited

U.S. PATENT DOCUMENTS 4,158,200 6/1979 Seitz et al. ..... 345/147

4,398,189 8/1983 Pasierb, Jr. et al. ..... 345/196

5,027,112 6/1991 Ross et al. ..... 345/82

*Primary Examiner*—Regina Liang

*Attorney, Agent, or Firm*—Lanny L. Parker

[57] ABSTRACT

A method and apparatus includes row-major memory mapping for a graphics memory (14) while providing data to a column-major display such as a pixel array (19). The transfer of data is provided from a row-major memory map to data formatted for refreshing a column-major display. The column-major pixel array (19) provides a display with energy saving benefits for illuminating the LEDs. A software developer can provide graphics data generated or transferred by a microcontroller (12) for storage in the row-major graphics memory (14). The embodiment supports the display features such as the grey-scale mode and bi-level mode.

18 Claims, 3 Drawing Sheets

LED DISPLAY CONTROLLER AND METHOD OF OPERATION

BACKGROUND OF THE INVENTION

The present invention relates, in general, to integrated circuit devices and, more particularly, to refresh methods for emissive displays.

Displays, such as Liquid Crystal Displays (LCDs), often have drivers for selecting pixels located on two sides of the display. The two sided access allows the LCD to be scanned in a manner similar to the conventional Cathode Ray Tubes (CRTs) which provide pixel access starting from the upper left corner of the display and proceeding from left-to-right and from top-to-bottom. Using this scanning method, the data stored in a memory map for the display is sequentially addressed in a row-major manner such that byte zero is horizontally adjacent to byte one. Thus, the bytes of data in the memory array are arranged as a digital representation of the data as it is visually viewed on the display.

A conventional Liquid Crystal Display (LCD) allows software programming of the display data that is encoded in bytes and stored in the graphics memory such that the data is transferred to the display in accordance with a visual conception of the data. For instance, a display that is two-hundred and forty pixels wide may store the first thirty bytes in a line buffer. The data in the memory is parallel loaded to a shift register and serially shifted one data bit at a time to the line buffer at the display. The line buffer circuitry at the display reassembles the serially shifted data which represents the data for the first line of the display. The thirty bytes stored in the line buffer at the display are presented in parallel, thus affecting all the pixels for the first line. From the software programmers point of view, the pixels in byte zero and byte one are horizontally adjacent and visually adjacent and all fall on the same axis. The row-major memory stores the entire first line of data for the display in the first thirty bytes of the memory.

Unlike a conventional LCD that is supplied with data sequentially addressed from graphical memory locations in accordance with a row-major display, a Light Emitting Device (LED) display is typically supplied with data addressed from graphical memory location in accordance with a column-major display. Instead of displaying the entire first line of pixels as in the case of the LCD, the LED display illuminates pixels on a column basis by providing sourcing and sinking currents to diodes in the display.

Hence, it would be advantageous to store data in a graphics memory for row-major addressing by providing that binary data to a LED display using column-major addressing. It would also be advantageous for such a method and apparatus to support even and odd interdigitated displays as well as bi-level and gray scale.

DETAILED DESCRIPTION OF THE DRAWING

Figure 1:
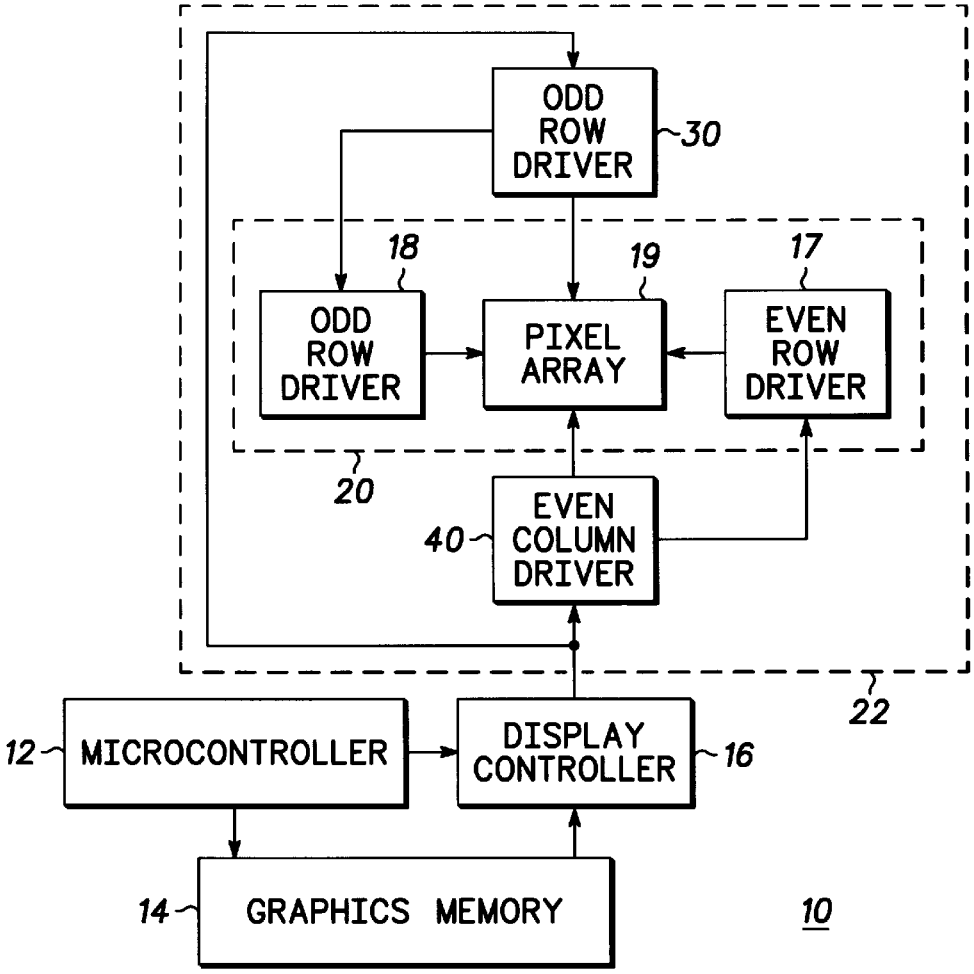
FIG. 1 is a block diagram of a virtual display module in accordance with an embodiment of the present invention.

FIG. 1 is a block diagram of a virtual display module 10 in accordance with an embodiment of the present invention. A microcontroller 12 is connected to a display controller 16 and also coupled to display controller 16 through graphics memory 14. "Odd" and "even" as used herein denote a first and a second. Display controller 16 is connected to odd column driver 30 and even column driver 40. Odd column driver 30 is connected to odd row driver 18 and pixel array 19 of array module 20. Even column driver 40 is connected to even row driver 17 and pixel array 19 of array module 20. Even row driver 17 and odd row driver 18 of array module 20 are connected to pixel array 19.

Microcontroller 12 receives or generates information that is stored in graphics memory 14 for the display, such as pixel array 19. The preferred embodiment for pixel array 19 is a Gallium Arsenide (GaAs) display of Light Emitting Diodes (LEDs). Alternate embodiments for pixel array 19 include displays comprising organic light emitting diodes, Field Emission Devices (FEDs), or Electro Luminescent (EL). Hereafter, the term LED could refer to any of these display types and the term diode could refer to any type of emissive device for illuminating an individual pixel in the display. It is understood that the invention is not limited to a particular display type. The binary data generated by microcontroller 12 or stored in graphics memory 14 is retrieved by display controller 16 and transmitted to odd column driver 30 and even column driver 40. Odd row driver 18 receives odd pixel data from display controller 16 and even row driver 17 receives even pixel data from display controller 16.

In the preferred embodiment, the odd columns of an image are created on emissive pixel array 19 by providing binary data from graphics memory 14 or microcontroller 12 through display controller 16 to odd column driver 30. Likewise, the even columns of an image in the preferred embodiment are created on pixel array 19 by providing pixel data from graphics memory 14 or microcontroller 12 through display controller 16 to even column driver 40. Odd row driver 18 receives data from odd column driver 30 and selects paths for providing bias voltages such that forward biased diodes (not shown) in a selected odd numbered column of an LED display emit light, such as pixel array 19. Also, even row driver 17 receives data from even column driver 40 and selects paths for providing bias voltages such that forward biased diodes (not shown) in a selected even numbered column of pixel array 19 emit light. Only one column is selected for illuminating diodes at any given time in pixel array 19.

Pixel array 19 can be an emissive GaAs display containing LEDs (not shown), such as 34,560 LEDs arranged in a 240 column by 144 row matrix. Data distributor 22 is a structure which selectively supplies even row and column data through even row driver 17 and even column driver 40 and then odd row and column data through odd row driver 18 and odd column driver 30 for display by pixel array 19. Display controller 16 fetches bytes of data from graphics memory 14 and data distributor 22 translates the binary data from row-major data into column-major data. Column drivers 30 and 40 and row drivers 17 and 18 provide source bias voltages and sink currents for illuminating the diodes (not shown) and thus, displaying the binary data from graphics memory 14 through the pixels of pixel array 19. Therefore, data distributor 22 is a controller for receiving graphics data and producing processed data for display on pixel array 19.

For instance, even row driver 17 provides both sourcing current for selected even numbered columns and sinking current for selected even numbered rows such that the individual LEDs in pixel array 19 that are forward biased are illuminated. When even row driver 17 selects an even numbered column, one or more selected even numbered rows illuminate one or more LEDs in accordance with each column selection and multiple row selections. No LEDs are illuminated when even row driver 17 is not providing a forward bias and sinking current for diodes in pixel array 19. Also, odd row driver 18 provides both sourcing current for selected odd numbered columns and sinking current for selected odd numbered rows such that individual LEDs in pixel array 19 are forward biased and illuminated. When even row driver 17 selects an odd numbered column, one or more selected odd numbered rows illuminate one or more LEDs in accordance with each column selection and multiple row selections. No LEDs are illuminated when odd row driver 18 is not providing a forward bias and sinking current for diodes in pixel array 19.

Several types of display modes, such as the bi-level mode and the gray-scale mode are used for displaying binary data supplied from microcontroller 12 or graphics memory 14. For example, the bi-level mode provides one bit of binary data per pixel, whereas, the gray-scale mode encodes four binary bits per pixel. The bi-level mode supports text images not requiring graphics with more than two levels of contrast, and therefore has memory space for storing four times as many pages of data in graphics memory 14 as can be stored for the gray-scale mode. The binary data creates images on pixel array 19 when either even row driver 17 or odd row driver 18 of array module 20 select paths for supplying a forward bias of about two volts for the LEDs (not shown).

In gray-scale mode, a pulse of controlled duration provides the time that each forward biased LED sinks current, thus lighting a pixel in pixel array 19 to a specified luminance. The four bits per pixel of encoded binary data in gray-scale mode provide sixteen levels of pixel illumination in accordance with decoding the four bits into a pulse width having granularity of sixteen widths. Other embodiments of the gray-scale mode support different levels of pixel illumination, such as eight levels of pixel illumination from three bits per pixel or four levels of pixel illumination from two bits per pixel.

In operation, a preferred embodiment of pixel array 19 is a non-persistent display requiring a data refresh rate above about 52 Hertz (Hz) to visually prevent a noticeable flicker. LED displays, such as pixel array 19, illuminate a pixel by forward biasing a diode and setting a current of about fifty to one-hundred microamps for pulsing the diode. Column zero is located on the left side and row zero is located at the top of the display, with column lines increasing from left-to-right and row lines increasing from top-to-bottom. In the preferred embodiment, pixel array 19 has columns 0–239 with the highest order column line 239 located on the right side and rows 0–143 with the highest order row line 143 located on the bottom.

Even column driver 40 provides a column counter (not shown) starting with a count of zero, representing column zero, and sequentially increments to a count of one-hundred and nineteen, representing column two-hundred and thirty-eight. Odd column driver 30 provides a column counter (not shown) starting with a count of one-hundred and nineteen, representing column one, and sequentially decrementing to a count of zero, representing column two-hundred and thirty-nine. Thus, odd column driver 30 selects only the odd numbered columns of pixel array 19 and even column driver 40 selects only the even numbered columns. The column counters in odd column driver 30 and even column driver 40 are synchronized such that when the counter in even column driver 40 has incremented to a count of one-hundred and nineteen, the counter in odd column driver 30 has decremented to a count of zero.

Column drivers 30 and 40 each provide counters (not shown) having one-hundred and twenty states and column drivers 30 and 40 operate out of phase to one another such that only one column in pixel array 19 is selected for sourcing current at a given time. The drivers, such as even row driver 17 and odd row driver 18, for the selected single column provide a sourcing current of about 14.4 microamps for supplying the 144 potential diodes located along that column in pixel array 19. In an alternate embodiment, individual columns in pixel array 19 could be addressed by a single counter providing a count or state for each column of the display. For those knowledgeable in the art, a shift register functioning as a pointer, a state-machine or software loops functioning as counters could provide selection of columns in pixel array 19. The method of selecting a column is not intended as a limitation of the present invention.

With pixel array 19 being interdigitated, the preferred embodiment has display driver 17 providing both current sourcing to a selected even column and current sinking for the diodes of pixel array 19 located in the even numbered rows. In accordance with data provided in a first register array (not shown) comprising seventy-two registers, display driver 17 provides encoded data for illuminating all of the even row seventy-two diodes in the column selected by the column counter. Likewise, odd row driver 18 provides current sourcing for the selected odd numbered column and current sinking for the diodes of pixel array 19 located in the odd numbered rows. In accordance with data provided in a second register array (not shown) comprising seventy-two registers, odd row driver 18 provides encoded data for illuminating all of the odd row seventy-two diodes in the column selected by the column counter. Thus, for a display such as pixel array 19 having one-hundred and forty-four rows, even row driver 17 and odd row driver 18 each provide one-half the drivers for current sinking the one-hundred and forty-four diodes along a selected column of pixel array 19.

In accordance with the selected column, register zero in the 0–71 register array (not shown) in even row driver 17 provides data for illuminating the diode in row zero of pixel array 19, while register one provides data for illuminating the diode in row two, etc. Thus, register seventy-one in even row driver 17 provides data for illuminating the diode in row two-hundred and thirty-eight. Also, in accordance with the selected column, register zero in the 0–71 register array (not shown) in odd row driver 18 provides data for illuminating the selected diode in row one of pixel array 19, while register one provides data for illuminating the diode selected in row three, etc. Thus, register seventy-one in odd row driver 18 provides data for illuminating the selected diode in row one-hundred and forty-three. All of the one-hundred and forty-four diodes along a selected column are supplied with data by the even row registers from even column driver 40 and the odd row registers from odd column driver 30 for sinking current such that all diodes along that selected column can be illuminated together.

In the preferred embodiment, each register in the 0–71 register array (not shown) for even row driver 17 and odd row driver 18 consists of a word that is eight bits of stored binary data. The eight data bits (D7–D0) for each of the seventy-two registers are stored such that in grey-scale mode the upper four bits (D7–D4) represent the current column pixel gray-scale value and the lower four bits (D3–D0) represent the next column pixel gray-scale value. In accordance with the stored four data bits for a gray-scale value, a pulse width is generated for sinking current to the selected diode in pixel array 19. However, in the bi-level mode the eight data bits (D7–D0) for each of the seventy-two registers are stored such that the highest order data bit (D7) is the current column pixel value, the next highest order data bit (D6) is the next column pixel value, etc. Thus, in the bi-level mode the eight data bits (D7–D0) represent eight successive columns of data for the pixel array 19 display associated with that particular row. In an alternate embodiment, the seventy-two registers could have word lengths other than the eight bits of stored data per word. For instance, each register could store sixteen data bits (D15–D0). The length of the data word is not intended as a limitation of the present invention.

Data distributor 22 has odd column driver 30 supplying binary data to odd row driver 18 and even column driver 40 supplying binary data to even row driver 17 as a complete column of data (column-major mode) for pixel array 19. In a column-major mode, data is not retrieved sequentially but rather in a stepwise fashion from a row-major storage device, such as graphics memory 14. Thus, data is retrieved from graphics memory 14 through display controller 16 by addressing byte zero, byte 64, byte 128, etc. By gathering data bytes from graphics memory 14 that are separated by an address count of sixty-four, data for the even rows of pixel array 19 is retrieved for even column driver 40. Array module 20 caches that block of data in even row driver 17.

Likewise, data from graphics memory 14 is retrieved through display controller 16 for the odd rows. In a column-major mode, data from graphics memory 14 is off-set by an address count of thirty-two and data bytes are retrieved in accordance with incrementing the address by a count of sixty-four. Array module 20 caches that block of column data for the odd rows in odd row driver 18. Thus, for a display such as pixel array 19, the column data is gathered for the odd rows by addressing the first byte (off-set of thirty-two) and retrieving that byte to odd column driver 30, incrementing the address by a step of sixty-four as the location for the second byte and retrieving the second byte to odd column driver 30, etc. Array module 20 stores eight columns of data in bi-level mode and two columns of data in grey-scale mode for illuminating the diodes of pixel array 19.

Figure 2:
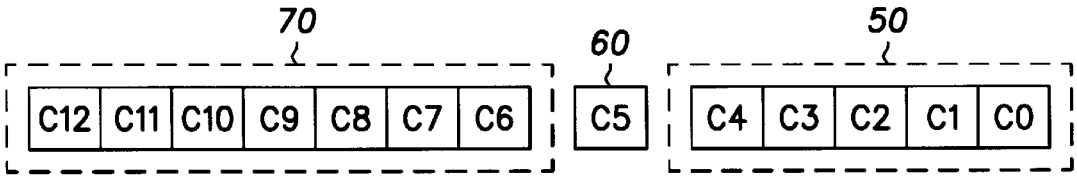
FIG. 2 is a block diagram for the segmented counters functioning as index registers for addressing a graphics memory.

FIG. 2 is a block diagram for segmented counters 48 functioning as index registers for addressing graphics memory 14. In the preferred embodiment, segmented address counter 48 consists of a five-bit lower address counter 50, a one-bit even/odd row indicator 60, and a seven-bit upper address counter 70. The least significant bits of the thirteen-bit segmented counter 48 are the five-bit lower address (C4–C0) of counter 50, then one-bit even/odd row indicator (C5) of counter 60, and the most significant bits are the seven-bit upper address (C12–C6) of counter 70. The counter stages for the three segmented counter sections, the lower address counter 50, the row indicator counter 60, and the upper address counter 70 can be incremented independently.

Segmented counter 48 with five-bit lower address counter 50 provides for skipping thirty-two bytes of data, such as matches or exceeds the number of bytes in the first line of the display, such as pixel array 19. The one-bit even/odd bit in counter 60 is used for indicating whether the data is for an even or an odd row of pixel array 19. The seven-bits of upper address counter 70 are incremented first, providing the addresses for sequentially stepping through memory and retrieving data for the seventy-two rows of a particular column in a byte wise fashion. By incrementing the seven higher order address bits of segmented counter 48, graphics memory 14 steps through every sixty-forth byte of data which corresponds to retrieving bytes of either even or odd row data for a selected column of pixel array 19.

When segmented counter 48 starts on an even row, as indicated by the binary value of the one-bit even/odd row indicator of counter 60, only data for the even rows is retrieved from graphics memory 14 and sent to even column driver 40. When incrementing the section of counter 70 with the seven higher order address bits, counter 70 reaches a boundary limit for counting the seventy-two even rows and the one-bit even/odd row indicator of counter 60 is toggled to select the odd rows. The odd row data is retrieved from graphics memory 14 by again incrementing counter 70 with the seven higher order address bits until counter 70 reaches the boundary limits for counting the seventy-two odd rows. Data for the odd rows is sent to even column driver 40. When the even and odd row data for a particular column have been retrieved from graphics memory 14, the one-bit even/odd row indicator in counter 60 is toggled to select even rows and the five-bit lower address counter 50 is incremented by one. When lower address counter 50 is incremented, upper address counter 70 is reset in preparation for retrieving data for the next column. Again, seven-bit upper address counter 70 is sequentially incremented and in accordance with the even/odd row indicator of counter 60, the binary data for the rows of pixel array 19 is retrieved column by column from graphics memory 14.

Figure 3:
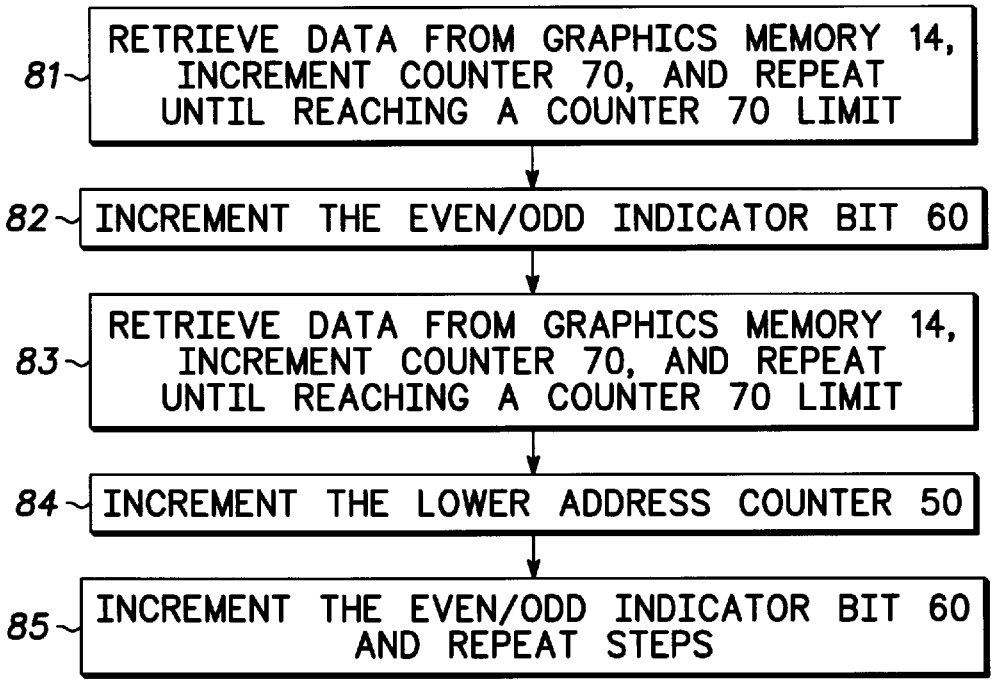
FIG. 3 illustrates a flow diagram for a method that provides an address to a graphics memory for retrieving row-major data in a column-major format.

FIG. 3 illustrates a flow diagram for a method that provides an address to graphics memory 14 for retrieving row-major data in a column-major format in a virtual display module 10. Lower counter 50 has a proper number of bits for providing a count that matches or exceeds the number of bytes necessary for displaying a single line of display data. In the preferred embodiment, a first counter 48 provides addresses for retrieving data from graphics memory 14 for even columns and a second counter 48 provides addresses for retrieving data for odd columns. Therefore, upper address counter 70 has a proper number of bits for providing a count for one half the number of columns in the graphics display.

In a first step (identified by box 81 of flow diagram 80), data is retrieved from graphics memory 14 in accordance with the address provided by segmented counter 48. Upper address counter 70 is incremented by one and data is retrieved, this step repeating until upper address counter 70 has provided an address for each row type, either even or odd, as indicated by the even/odd identifier value. For example, in the preferred embodiment, pixel array 19 has seventy-two even rows and upper address counter 70 would provide at least seventy-two states prior to reaching the counter limit.

The second step (identified by box 82 of flow diagram 80) increments the even/odd indicator bit of counter 60. Thus, the binary value of the even/odd indicator bit of counter 60 is different from the binary value held during the first step. In the third step (identified by box 83 of flow diagram 80), data is retrieved from graphics memory 14 in accordance with the address provided by segmented counter 48. Upper address counter 70 is incremented by one and data is retrieved, this step repeating until upper address counter 70 has provided an address for each row type as indicated by the even/odd identifier value held during the second step. In the fourth step (identified by box 84 of flow diagram 80), the lower address counter 50 is incremented by one. In the fifth step (identified by box 85 of flow diagram 80), the binary value of the even/odd indicator bit of counter 60 is toggled and steps one through five are repeated. The process of incrementing segmented counter 48 is complete when the lower address counter 50 has provided a count that matches or exceeds the number of bytes necessary for displaying a single line of display data.

Figure 4:
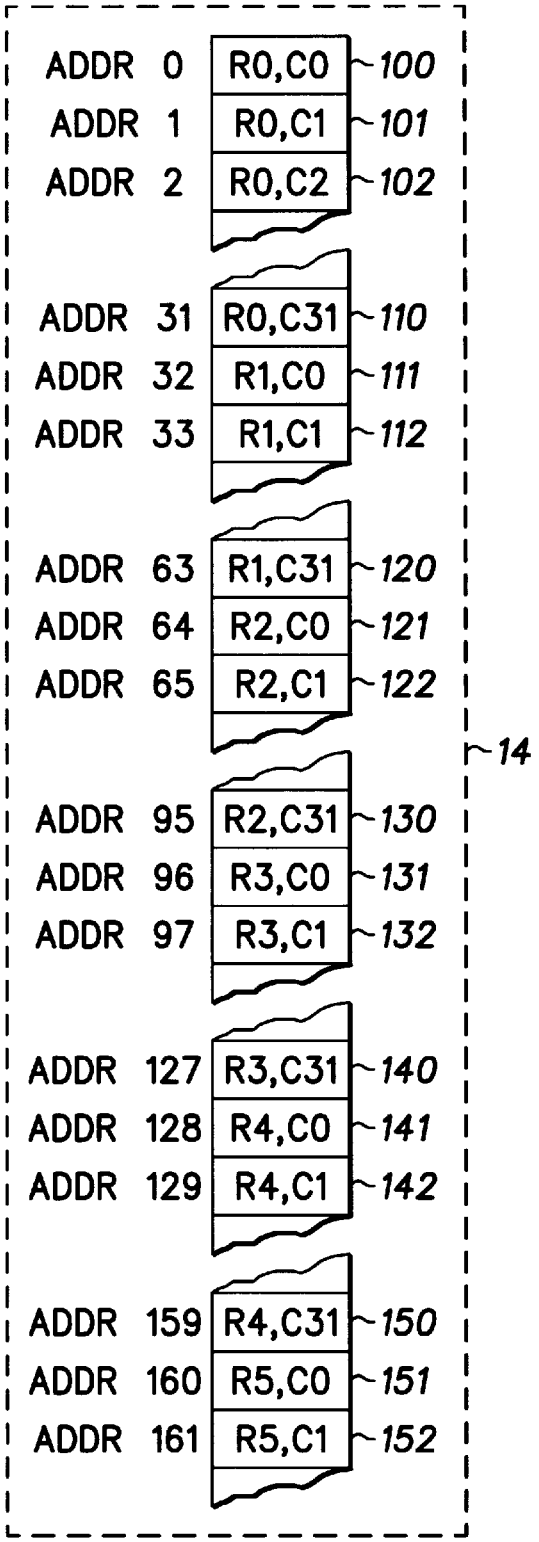
FIG. 4 illustrates a row-major graphics memory.

FIG. 4 illustrates row-major graphics memory 14 and the sequence for selecting bytes of stored data in accordance with the addresses provided by segmented counter 48. The preferred embodiment has a row-major memory map for graphics memory 14 such that the data for display on the first line of pixel array 19 is located in the first thirty-two address locations. Therefore, the first byte of data for row zero of pixel array 19 is located in box 100, the second byte of data for row zero is in box 101, the third byte of data for row zero is in box 102, etc. Boxes 100–102 represent bytes of data at address locations 0–2. In the preferred embodiment for pixel array 19, the first horizontal line of the display has thirty bytes of data. For example, graphics memory 14 stores this first line of data in the first thirty-two address locations as represented by boxes 100–110. The second line of data for pixel array 19 is stored in boxes 111–120.

Boxes 110–112, 120–122, 130–132, 140–142, and 150–152 represent additional bytes of data stored in graphics memory 14 that indicate address locations for the end of one row and the beginning of the following row. The preferred embodiment has thirty bytes of data for displaying data in each row of pixel array 19, but thirty-two bytes are allocated for each row in graphics memory 14. The last two bytes of data for each line in graphics memory 14 are unused.

Figure 5:
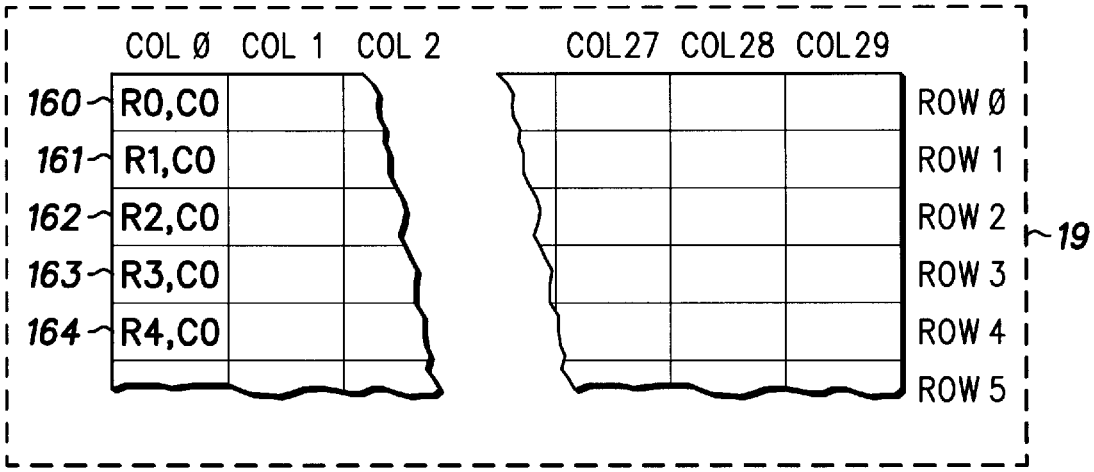
FIG. 5 illustrates the placement of processed data bytes for illuminating pixels in a column-major display.

FIG. 5 illustrates the placement of processed data bytes for illuminating pixels in column-major pixel array 19. For instance, box 160 in column-major pixel array 19 receives the byte of data from box 100 in graphics memory 14. Segmented counter 48 in FIG. 2 would have a value of 00'h (00'h represents hexadecimal values) for the lower five-bits of counter 50, a 0'h for the value of even/odd indicator of counter 60, and a value of 00'h for the upper seven-bits of counter 70. For instance, the even/odd indicator with a binary value of zero could represent an even row in pixel array 19. In accordance with the first step of FIG. 3, the byte of data with a value of R0,C0 in box 100 is stored to be displayed in location 160 in pixel array 19 and upper address counter 70 is incremented to a value of 01'h, which corresponds to address location sixty-four. The byte of data labeled R2,C0 in box 121 of graphics memory 14 is retrieved and stored to be displayed in location 162 of pixel array 19. Thus, the second byte of data retrieved is data for the same column and row type as the first data retrieved. The upper address counter 70 is again incremented to a value of 02'h, which corresponds to address location one-hundred and twenty-eight and the byte of data represented by R4,C0 in box 141 is retrieved and stored. In this manner, the data for all the seventy-two even rows in column zero (col 0) is retrieved from graphics memory 14.

In accordance with the second step of FIG. 3, the even/odd indicator value in counter 60 is incremented to a value of 1'h. For instance, a value of one (1'h) could represent an odd row in pixel array 19. Having reached the counter limit, the upper address counter 70 again starts with a value of 00'h, but counter 60 having a value of one provides a thirty-two bit address off-set. In accordance with the third step of FIG. 3, the byte of data in box 111 with a value of R1,C0 at address thirty-two is retrieved and stored to be displayed in location 161 of pixel array 19. Counter 70 is incremented to a value of 01'h and the byte value R3,C0 in box 131 at address ninety-six is retrieved and stored to be displayed in location 163 of pixel array 19. In this manner, the data for all the seventy-two odd rows in column zero (col 0) is retrieved from graphics memory 14. Once data for the even and odd rows of column zero has been gathered and stored, the data is displayed in a column-major manner such that pixels along column zero are illuminated in accordance with the values for the binary data.

In accordance with the fourth step of FIG. 3, the lower address counter 50 is incremented to a value of 01'h. In accordance with the fifth step of FIG. 3, the even/odd indicator bit in counter 60 is incremented. The process is repeated for gathering column one data for the even rows, and then the odd rows such that data for all bytes is stored for display in column one of pixel array 19. In the preferred embodiment, once data for the even and odd rows of column one has been gathered and stored, the data is displayed in a column-major manner such that one-hundred and forty-four pixels along column one are illuminated in accordance with the values for the binary data.

During the time for displaying one column of data, the data of seventy-two rows for illuminating the adjacent column are preloaded in the display driver buffers. Even rows are preloaded during even column display cycles and odd rows are preloaded during odd column display cycles. For instance, in the grey-scale mode the seventy-two rows of data for column zero are pre-loaded in odd row driver 18 and the seventy-two rows of data for column one are pre-loaded in even row driver 17. While pixel array 19 displays the data for column zero, seventy-two rows of data for column two are loaded in even row driver 17. While pixel array 19 displays the data for column one, seventy-two rows of data for column three are loaded in odd row driver 18. Thus, the small cache within even row driver 17 and odd row driver 18 provides for a preload of data as the prior data is displayed by pixel array 19.

In the preferred embodiment, the selected column driver as provided from odd column driver 30 or even column driver 40 sources current for about seventy-two microseconds in accordance with a clock frequency of about 1.25 mega-hertz (MHz). The seventy-two microseconds of sourcing current per column of pixel array 19 times the total of two-hundred and forty columns provides a display refresh time of about 17.3 milliseconds for pixel array 19. A refresh frequency of about fifty-eight hertz is provided which satisfies the requirement of a data refresh rate above about 52 Hertz (Hz) to visually prevent a noticeable flicker. Thus, odd column driver 30 and even column driver 40, each with an eight-bit wide data bus can transfer seventy-two bytes of row data per scan cycle for illuminating the one-hundred and forty-four pixels along a particular column of pixel array 19. In an alternate embodiment, the one-hundred and forty-four pixels could be loaded with a clock speed of 250 MHz. Alternately, a sixteen-bit data bus could transfer data at a clock speed of 1.25 MHz. The method of providing data from a memory to a display, such as through an eight-bit or a sixteen-bit bus, and clock frequencies for transferring that data, such as clock frequencies of 1.25 MHz or 2.5 MHz, is not intended as a limitation of the present invention.

By now it should be appreciated that the present invention provides a system that allows row-major memory mapping for graphics memory 14 but still allows a column-major display such as pixel array 19. The invention provides a transfer of data from a row-major memory map to data formatted for refreshing a column-major display. The column-major display gives energy savings benefits for illuminating the pixels, i.e., better efficiency for the LEDs. Yet, the row-major graphics memory 14 allows the software developer to provide graphics data for storage in a visually adaptable mode. Display features such as the grey-scale mode and bi-level mode are supported.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention. For example, the display memory could be comprised of multiple latches arranged in a register array, dual ported Random Access Memory (RAM), Static Random Access Memory (SRAM), Dynamic Random Access Memory (DRAM), Electrically Programmable Read Only Memory (EPROM) or the like.

What is claimed is:

1. A display module, comprising:

a storage device for storing graphics data;

a counter coupled to the storage device and providing a lower address for selecting a location in a row and an upper address for selecting the row, where incrementing the upper address provides data for a column at the location in the row;

an emissive display coupled to the storage device for receiving the data for the column and producing a display therefrom.

2. The display module of claim 1, wherein the counter further includes a data bit that designates data as even and odd.

3. The display module of claim 1, wherein the storage device is a row-major memory map.

4. The display module of claim 1, wherein the emissive display is column-major display.

5. The display module of claim 1, wherein the data distributor translates binary data stored in the storage device for a grey-scale mode and a bi-level mode.

6. A device for translating binary data, comprising:

a storage device for providing graphics data stored in a row;

a segmented counter coupled to the storage device and providing a lower address for selecting a location in the row and an upper address for selecting the row, where incrementing the upper address provides data for a column at the location in the row; and a column-major display coupled to the storage device for producing a display of processed graphics data.

7. The device of claim 6, wherein the segmented counter has a lower address counter, an even/odd bit, and an upper address counter.

8. The device of claim 7, wherein the lower address counter provides counter stages in accordance with counting a number of bytes for one line of the column-major display.

9. The device of claim 7, wherein the even/odd bit indicates even versus odd row data retrieved from the column-major display.

10. The device of claim 7, wherein the upper address counter is coupled to the row-major storage device and provides addresses for the row-major storage device for retrieving even row data for a selected column.

11. The device of claim 7, wherein the upper address counter is coupled to the row-major storage device and provides addresses for the row-major storage device for retrieving odd row data for a selected column.

12. The device of claim 7, wherein the lower address counter is incremented when the upper address counter reaches a boundary limit.

13. The device of claim 7, wherein the even/odd bit is incremented when the upper address counter reaches a boundary limit.

14. The device of claim 7, wherein the lower address counter is incremented when the upper address counter reaches a boundary limit after retrieving data from the row-major storage device for odd rows.

15. A method for providing data to an emissive display comprising the steps of:

selecting particular data bits from data words of a row-major memory for activating a column of display elements of a column-major display; and incrementing a segmented counter, wherein the segmented counter has a lower address counter, an even/odd bit, and an upper address counter.

16. The method of claim 15, wherein the step of incrementing the segmented counter comprises the step of incrementing the upper address counter for counting row data in the row-major memory.

17. The method of claim 16, wherein the step of incrementing the segmented counter comprises the step of incrementing the even/odd bit when the upper address counter reaches a boundary limit for tracking even versus odd row data in the row-major memory.

18. The method of claim 17, wherein the step of incrementing the segmented counter comprises the step of incrementing the lower address counter when the upper address counter reaches the boundary limit and the even/odd bit indicates a value for odd.

* * * * *